US008759699B2

(12) United States Patent
Yuasa

(10) Patent No.: US 8,759,699 B2
(45) Date of Patent: Jun. 24, 2014

(54) PUSH-BUTTON SWITCH

(75) Inventor: Eiji Yuasa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 528 days.

(21) Appl. No.: 13/127,376

(22) PCT Filed: Feb. 13, 2009

(86) PCT No.: PCT/JP2009/052407

§ 371 (c)(1),
(2), (4) Date: May 3, 2011

(87) PCT Pub. No.: WO2010/092679

PCT Pub. Date: Aug. 19, 2010

(65) Prior Publication Data

US 2011/0209974 A1 Sep. 1, 2011

(51) Int. Cl.
*H01H 9/00* (2006.01)

(52) U.S. Cl.
USPC ..... 200/314; 200/344

(58) Field of Classification Search
USPC ..... 200/314
See application file for complete search history.

(56) References Cited

U.S. PATENT DOCUMENTS

| | | | | |
|---|---|---|---|---|
| 8,247,714 | B2 * | 8/2012 | Tsai | 200/5 A |
| 8,592,702 | B2 * | 11/2013 | Tsai | 200/311 |
| 2005/0006215 | A1 | 1/2005 | Sasaki et al. | |
| 2008/0006516 | A1 * | 1/2008 | Nishino et al. | 200/345 |
| 2008/0130263 | A1 | 6/2008 | Liu et al. | |

FOREIGN PATENT DOCUMENTS

| | | | |
|---|---|---|---|
| CN | 1567498 | A | 1/2005 |
| JP | 2003-12248 | A | 1/2003 |
| JP | 2003 272473 | | 9/2003 |
| JP | 2004-227997 | A | 8/2004 |
| JP | 2008 140761 | | 6/2008 |
| JP | 2008 147127 | | 6/2008 |
| JP | 2008 171794 | | 7/2008 |
| JP | 2008 251364 | | 10/2008 |
| TW | 200824533 | A | 6/2008 |

OTHER PUBLICATIONS

Combined Office Action and Search Report issued Jun. 28, 2013 in Chinese Patent Application No. 200980149718.4 (with English language translation).
International Search Report issued Mar. 24, 2009 in PCT/JP09/52407 filed Feb. 13, 2009.
Extended European Search Report issued Oct. 31, 2013 in European Patent Application No. 09839999.1.

* cited by examiner

*Primary Examiner* — Renee Luebke
*Assistant Examiner* — Lheiren Mae Caroc
(74) *Attorney, Agent, or Firm* — Oblon, Spivak, McClelland, Maier & Neustadt, L.L.P.

(57) ABSTRACT

In a push-button switch, a mark for conveying information to a user is disposed on a portion of a front surface of a push-button for operating a switch main body. A light-guiding plate is disposed between the switch main body and the push-button. A mark diffusing portion that diffuses injected light is disposed on a portion of the light-guiding plate that faces the mark. A mark light source portion injects light into the light-guiding plate so as to be directed toward the mark diffusing portion.

5 Claims, 8 Drawing Sheets

PUSH-BUTTON SWITCH

TECHNICAL FIELD

The present invention relates to a push-button switch that can be used, for example, in elevator landing button apparatuses, or car operating panels, etc.

BACKGROUND ART

Push-button switches that can be used as elevator switches that perform designation of destination floors or opening and closing of doors, etc., have been proposed that use tactile switches in order to provide a clicking sensation during a pushing operation, and that include an illuminating portion for illuminating the push-button from inside to display a switch operating state (see Patent Literature 1, for example).

In conventional elevator operating panels, symbols that represent functions of operating buttons have also been formed so as to protrude from button surfaces in order to enable visually impaired people to determine the functions of the operating buttons (see Patent Literature 2, for example).

PATENT LITERATURE 1

Japanese Patent Laid-Open No. 2003-272473 (Gazette)

PATENT LITERATURE 2

Japanese Patent Laid-Open No. 2003-12248 (Gazette)

DISCLOSURE OF THE INVENTION

Problem to be Solved by the Invention

Elevator switches include types that are embedded in wall surfaces and wall-mounted types that are mounted to wall surface panels that are attached to wall surfaces. In the wall-mounted types, it is desirable to configure the push-button switches so as to be as thin as possible in order to reduce operating panel projection.

By configuring elevator switches so as to impart a clicking sensation, switch operation can be recognized by sense of touch, enabling them to have superior usability. In such cases, tactile switches are also useful as elevator switches from the viewpoint of imparting a clicking sensation. However, because they are configured such that the clicking sensation is issued by turning a movable contact inside out that is formed so as to have a dome shape, it is necessary to use a large movable contact in order to increase durability and extend service life, making it difficult to achieve both thickness reductions and durability, thereby making them difficult to use as wall-mounted elevator switches.

In addition, in elevator switches, a sense of quality can be imparted to a design surface by illuminating the entire control surface uniformly at a level that is not visually incongruous. In the conventional constructions that have been mentioned above, flat illuminating portions are used that utilize light-guiding plates and light-emitting diodes (LEDs) in order to achieve overall reductions in the thickness of the push-button switches and uniform illumination of the entire control surface, but it is necessary to dispose moving parts so as to avoid the illuminating portions since the illuminating portions are fixed on a case side, and there have been disadvantages in using them as elevator switches such as the thickness of the push-button being increased proportionately or external shapes expanding in both directions.

Furthermore, in conventional elevator operating panels such as those described above, it is difficult for weak-sighted users to locate symbols, and as a result, operation takes time since finding the symbols takes time.

The present invention aims to solve the above problems and an object of the present invention is to provide a push-button switch that can improve operability by enabling reductions in thickness while ensuring a clicking sensation, by achieving uniform illumination of an entire control surface, and by enabling even weak-sighted users to distinguish functions swiftly.

Means for Solving the Problem

In order to achieve the above object, according to one aspect of the present invention, there is provided a push-button switch including: a plunger that includes a push-button that is made of a light-transmitting material; a lever linking mechanism that translates the plunger; and a switch main body that is operated together with a pressing action of the plunger, the plunger, the lever linking mechanism, and the switch main body being mounted to a base, the lever linking mechanism including: a pair of lever links that are disposed on the base so as to be abutted so as to be pivotable around an intermediate pivoting point; and joint members that link abutted end portions of the lever links to each other, the lever links being operable by the plunger, an operating segment that faces the switch main body being disposed so as to span the lever links, and the lever links being forced by springs that are engaged in outer end portions of the lever links so as to be pulled toward each other to enable the lever linking mechanism to perform a snap action in a direction of movement of the plunger together with a pivoting operation of the lever links that accompanies displacement of the plunger, the switch main body being configured so as to be pressed and operated by the operating segment that moves in the direction of movement of the plunger together with the action of the lever linking mechanism, and a flat illuminating portion that illuminates the push-button from behind being mounted so as to be able to move integrally with the plunger, wherein: a mark for conveying information to a user is disposed on a portion of the push-button; the illuminating portion includes: a light-guiding plate that is disposed between the switch main body and the push-button; and a mark light source portion; a mark diffusing portion that diffuses injected light is disposed on a portion of the light-guiding plate that faces the mark; and light is injected into the light-guiding plate from the mark light source portion so as to be directed toward the mark diffusing portion.

BEST MODE FOR CARRYING OUT THE INVENTION

Preferred embodiments of the present invention will now be explained with reference to the drawings.

Embodiment 1

Figure 1:
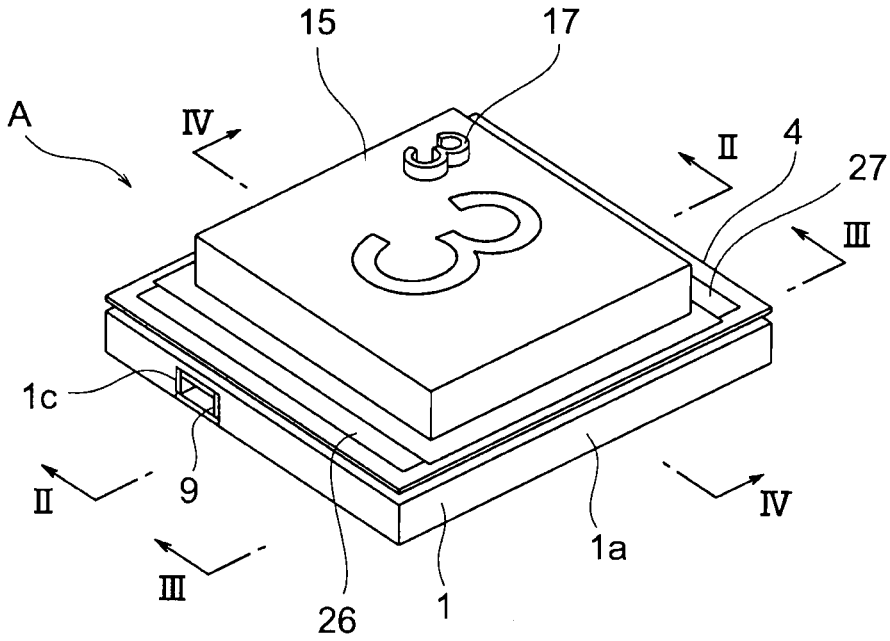
FIG. 1 is a perspective that shows a push-button switch according to Embodiment 1 of the present invention.
Figure 2:
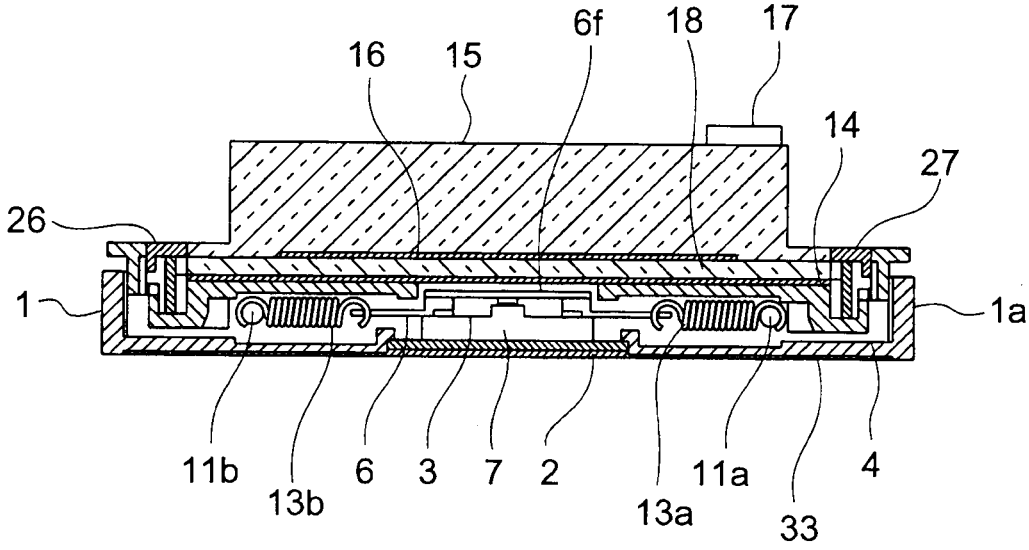
FIG. 2 is a cross section that is taken along Line II-II in FIG. 1.
Figure 3:
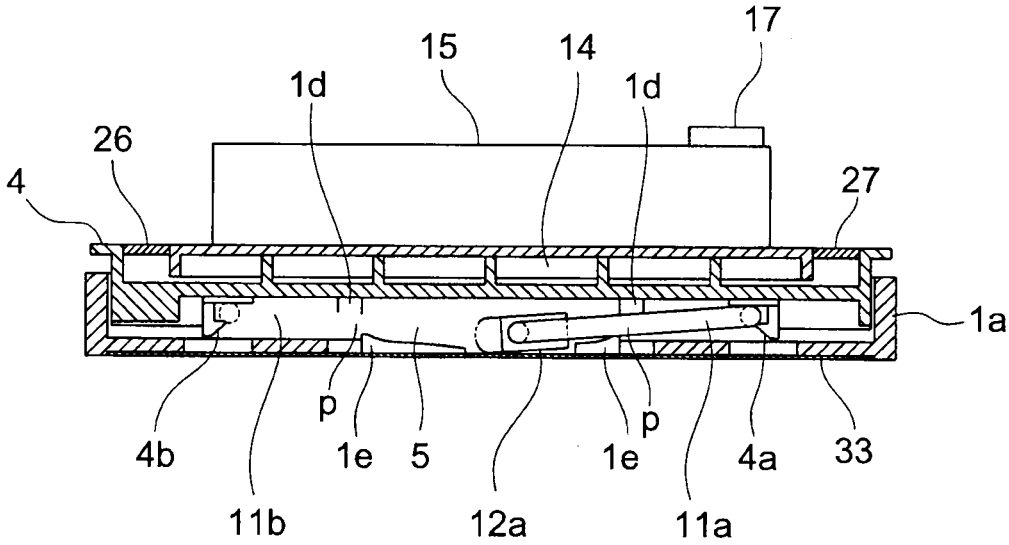
FIG. 3 is a cross section that is taken along Line III-III in FIG. 1.
Figure 4:
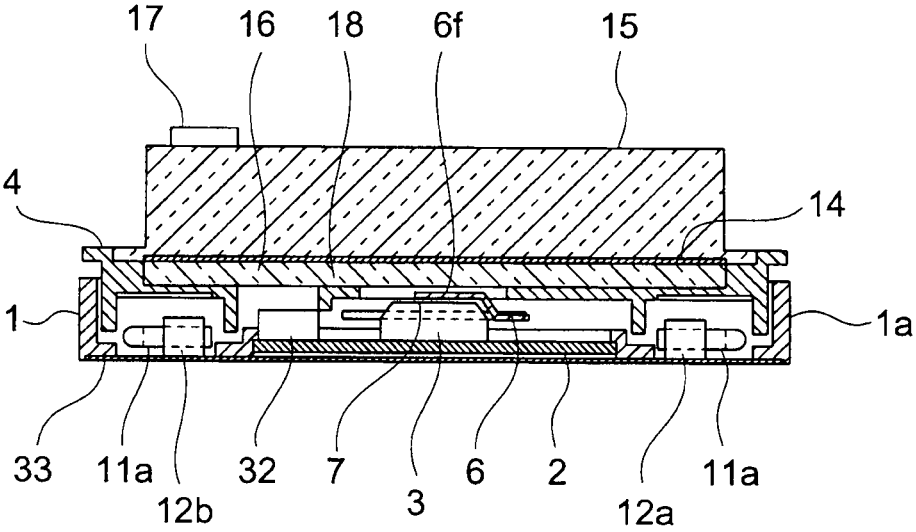
FIG. 4 is a cross section that is taken along Line IV-IV in FIG. 1.
Figure 5:
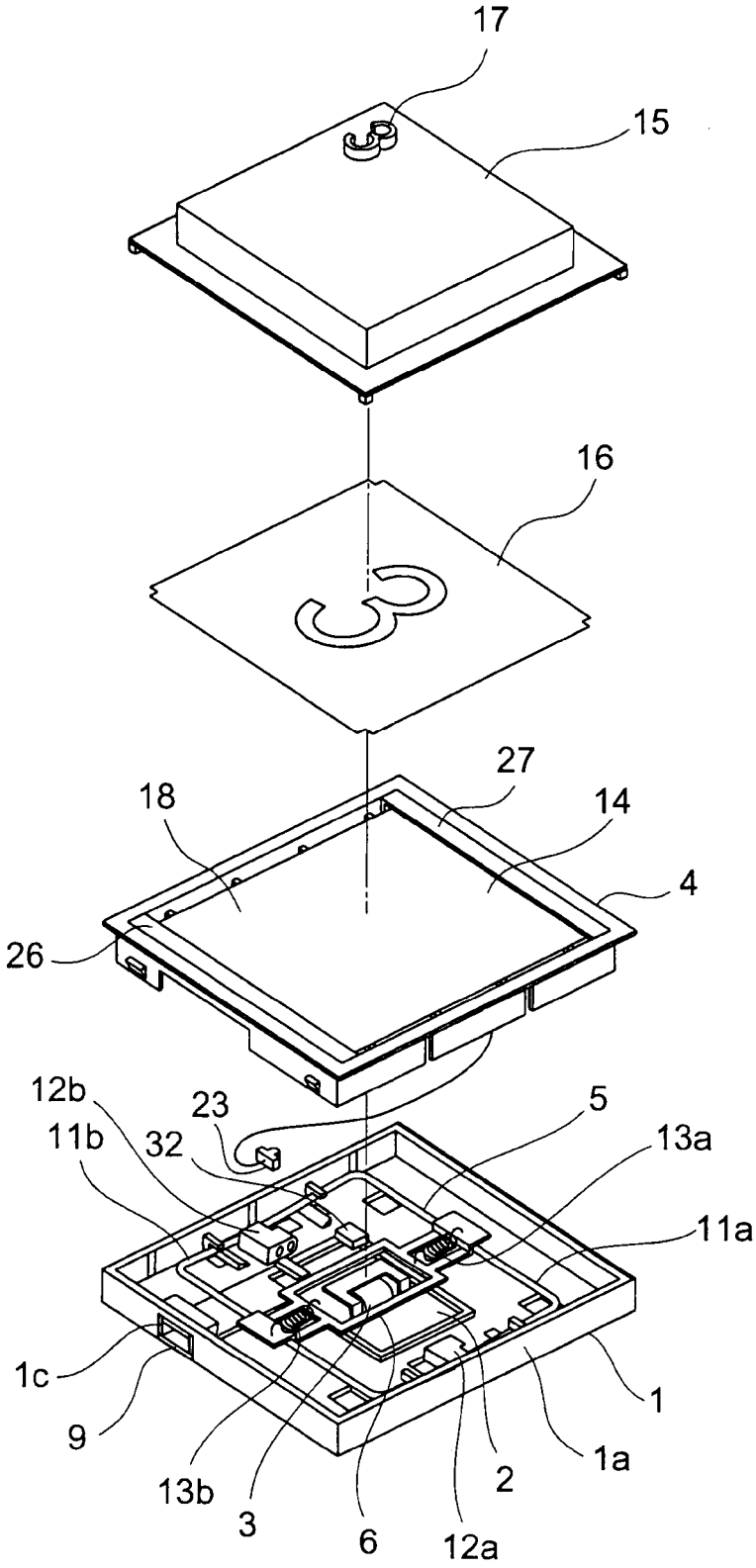
FIG. 5 is an exploded perspective that shows the push-button switch from FIG. 1.
Figure 6:
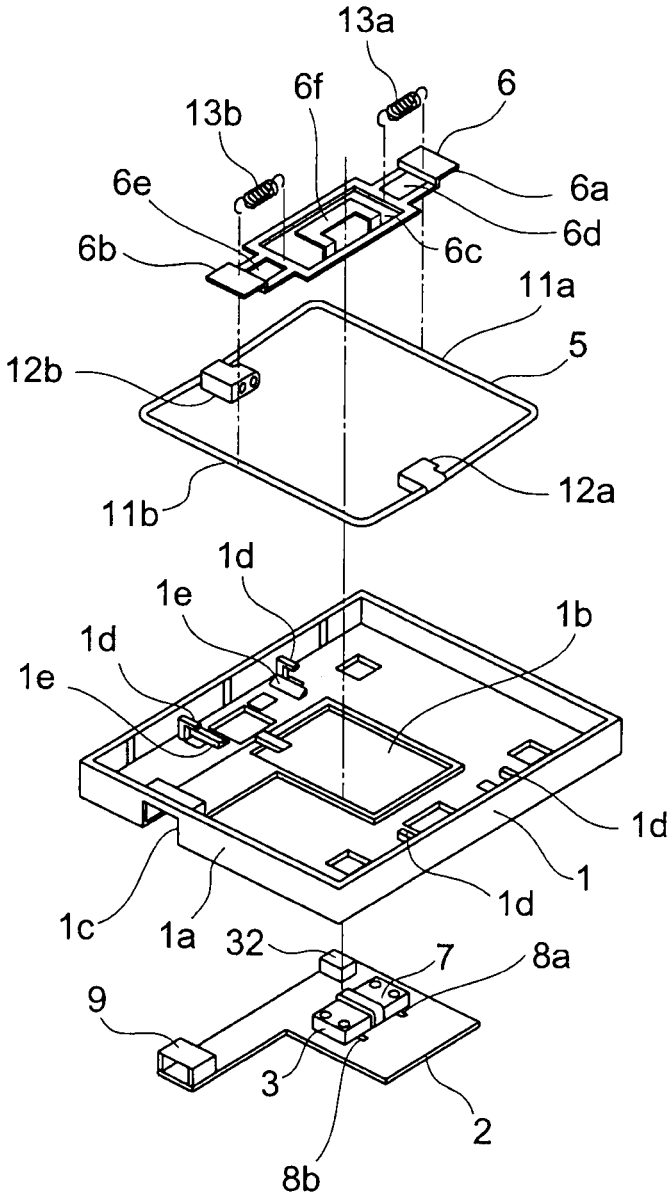
FIG. 6 is a perspective that shows a base portion from FIG. 5 further exploded.

FIG. 1 is a perspective that shows a push-button switch according to Embodiment 1 of the present invention, FIG. 2 is a cross section that is taken along Line II-II in FIG. 1, FIG. 3 is a cross section that is taken along Line III-III in FIG. 1, FIG. 4 is a cross section that is taken along Line IV-IV in FIG. 1, FIG. 5 is an exploded perspective that shows the push-button switch from FIG. 1, and FIG. 6 is a perspective that shows a base portion from FIG. 5 further exploded, a push-button switch that can be used in an elevator car operating panel being shown in this example.

In the figures, a circuit board 2, a switch main body 3, a plunger 4, a lever linking mechanism 5 for translating the plunger 4, and an operating segment 6 that presses and operates the switch main body 3, etc., are installed on a base 1.

The base 1 is configured into shallow box shape in which a low peripheral wall 1*a* is disposed so as to stand around a rectangular or square bottom surface portion. An aperture 1*b* is disposed centrally on the bottom surface portion of the base 1. An aperture 1*c* is disposed on the peripheral wall 1*a*.

The circuit board 2 is disposed on the bottom surface portion of the base 1 so as to face the aperture 1*b*. The circuit board 2 is inserted into the aperture 1*b* from a rear surface side of the base 1 and is fixed to the base 1. An identification plate 33 is affixed to the rear surface of the base 1. The aperture 1*b* is closed by the identification plate 33.

The switch main body 3 is mounted onto the circuit board 2 so as to be positioned approximately centrally on the base 1. A thin leaf switch is used as the switch main body 3. An operating lug 7 is disposed on an upper surface of the switch main body 3. A pair of tabular external terminals 8*a* and 8*b* are led out from side portions of the switch main body 3. These external terminals 8*a* and 8*b* are electrically connected to circuit patterns on the circuit board 2.

A connector 9 to which external wiring is connected is mounted to an end portion on the circuit board 2. The connector 9 passes through the aperture 1*c* and is exposed outside the base 1.

The lever linking mechanism 5 has: a pair of lever links 11*a* and 11*b* in which a metal wire material is bent into angular C shapes; a pair of joint members 12*a* and 12*b* that link the two end portions of the lever links 11*a* and 11*b* to each other; and a pair of helical extension springs 13*a* and 13*b* for snap action. First end portions of the lever links 11*a* and 11*b* are pivotably inserted into the joint members 12*a*. Second end portions of the lever links 11*a* and 11*b* are also pivotably inserted into the joint members 12*b*. Thus, the angle between the lever links 11*a* and 11*b* is variable.

The operating segment 6 is formed into an elongated shape by punching a thick plate metal material. Engaging portions 6*a* and 6*b* are formed on two end portions of the operating segment 6 by bending. The engaging portion 6*a* is engaged in an intermediate portion of the lever link 11*a*. The engaging portion 6*b* is engaged in an intermediate portion of the lever link 11*b*.

An aperture 6*c* is disposed on a central portion of the operating segment 6. The helical extension spring 13*a* is disposed between an edge portion of the aperture 6*c* and the engaging portion 6*a*. The helical extension spring 13*b* is disposed between an edge portion of the aperture 6*c* and the engaging portion 6*b*. The lever links 11*a* and 11*b* are thereby pulled toward each other. Notch portions 6*d* and 6*e* that accommodate the helical extension springs 13*a* and 13*b* are also disposed on the operating segment 6.

In addition, an operating tongue portion 6*f* is formed into a cantilevered shape on a central portion of the operating segment 6 by cutting out. The operating tongue portion 6*f* is placed in contact with an upper surface (an operating surface) of the operating lug 7.

Four sets of upper portion lugs 1*d* and lower portion lugs le are formed on inner surfaces of the peripheral wall 1*a*. The respective lever links 11*a* and 11*b* are inserted between upper portion lugs 1*d* and lower portion lugs le, and are pivoted such that the inserted portions function as pivoting points ("p" in FIG. 3). Intermediate portions of the lever links 11*a* and 11*b* are also engaged in engaging lugs 4*a* and 4*b* that are disposed on the plunger 4.

The plunger 4 is configured into a shallow rectangular box shape, and is inserted inside the base 1. A flat, rectangular illuminating portion 14 is fitted inside the plunger 4. A rectangular push-button 15 that is made of a transparent resin is disposed over the illuminating portion 14. The push-button 15 is fitted into the plunger 4 so as to cover the illuminating portion 14.

A display sheet 16 to which a display that corresponds to the user's request is affixed (in this case, a floor number) is interposed between the illuminating portion 14 and the push-button 15. A mark 17 for conveying information to the user by sense of touch is disposed on a portion of a front surface of the push-button 15. In this example, the mark 17 projects outward from the front surface of the push-button 15, and shows the floor number of the corresponding destination floor as the information.

Figure 7:
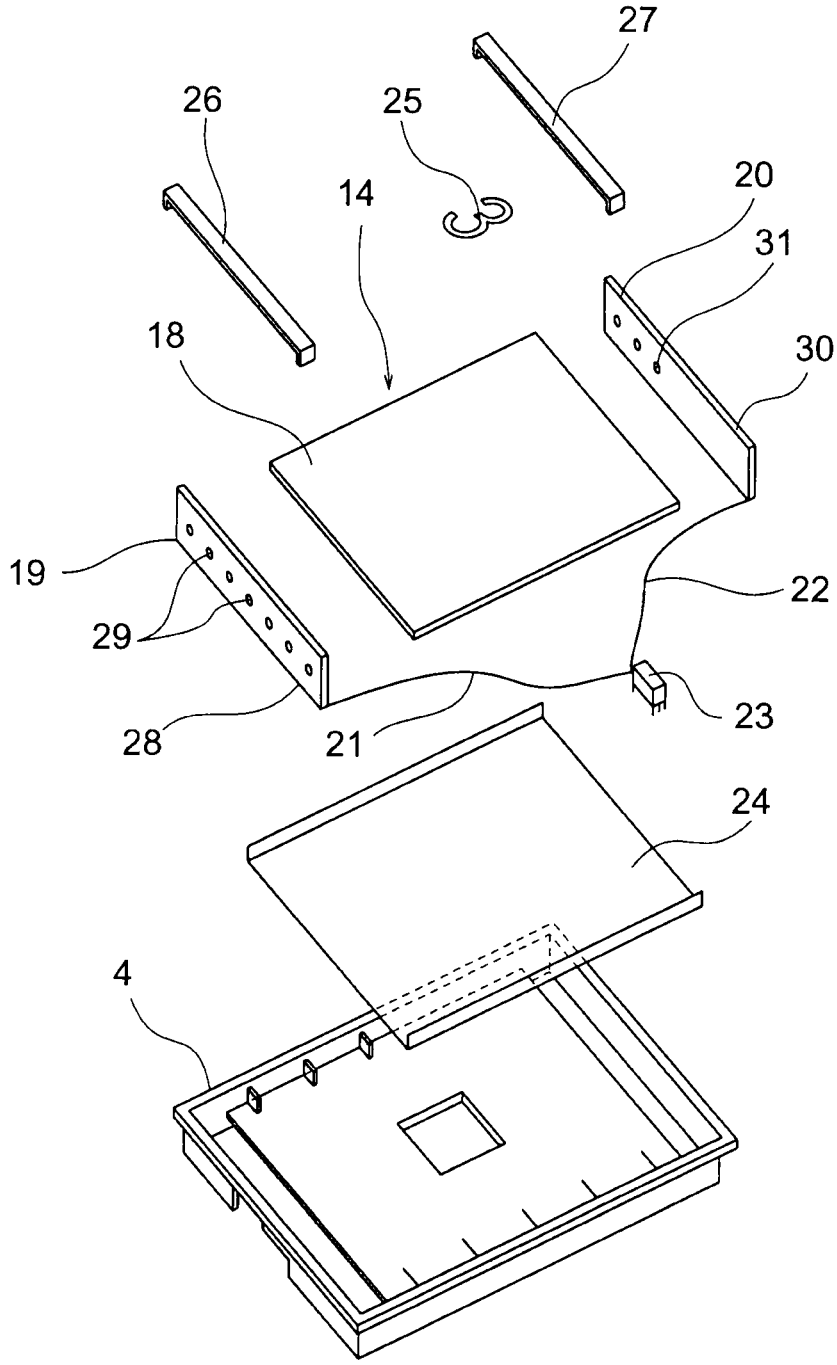
FIG. 7 is a perspective that shows an illuminating portion from FIG. 5 further exploded.

FIG. 7 is a perspective that shows the illuminating portion 14 from FIG. 5 further exploded. The illuminating portion 14 has: a flat plate-shaped light-guiding plate 18, a main light source portion 19, a mark light source portion 20, first wiring 21, second wiring 22, a light source connector 23, a main diffusing portion 24, a mark diffusing portion 25, a first light source cover 26, and a second light source cover 27.

The main light source portion 19 and the mark light source portion 20 inject light into the light-guiding plate 18 from side surfaces of the light-guiding plate 18 that face each other. The main light source portion 19 has: an elongated first light source circuit board 28; and a plurality of first LEDs 29 that are disposed on the first light source circuit board 28 so as to be spaced apart from each other. The first LEDs 29 are arranged in a straight line. The mark light source portion 20 has: an elongated second light source circuit board 30; and a plurality of second LEDs 31 that are disposed on the second light source circuit board 30 so as to be spaced apart from each other. The second LEDs 31 are arranged in a straight line.

The first LEDs 29 are disposed over an entire width direction of the light-guiding plate 18, and inject light into the entire light-guiding plate 18. The second LEDs 31 are disposed only on a portion of the light-guiding plate 18 in the width direction, i.e., a region in which the mark diffusing portion 25 is disposed, and inject light into the light-guiding plate 18 partially. Consequently, the number of second LEDs 31 is less than the number of first LEDs 29.

The light source connector 23 is connected to the main light source portion 19 and the mark light source portion 20 so as to have the first and second wiring 21 and 22 interposed. The light source connector 23 is connected to a circuit board connector 32 that is disposed on the circuit board 2. The main light source portion 19 and the mark light source portion 20 are each switched on and off independently.

Diffusing sheets that diffuse (scatter) the light that is injected into the light-guiding plate 18 are used as the main diffusing portion 24 and the mark diffusing portion 25. The main diffusing portion 24 covers an entire rear surface of the light-guiding plate 18 and side surfaces on which the light source portions 19 and 20 are not disposed.

The mark diffusing portion 25 is disposed only on a portion of the front surface of the light-guiding plate 18 on which the mark 17 is disposed. In this example, the mark diffusing portion 25 has a similar shape to the horizontal shape of the mark 17, and is disposed so as to overlap with the mark 17 when viewed from in front.

Two end portions of the first and second light source covers 26 and 27 are engaged in the plunger 4. The light-guiding plate 18 and the light source portions 19 and 20 are thereby fixed to the plunger 4.

Figure 8:
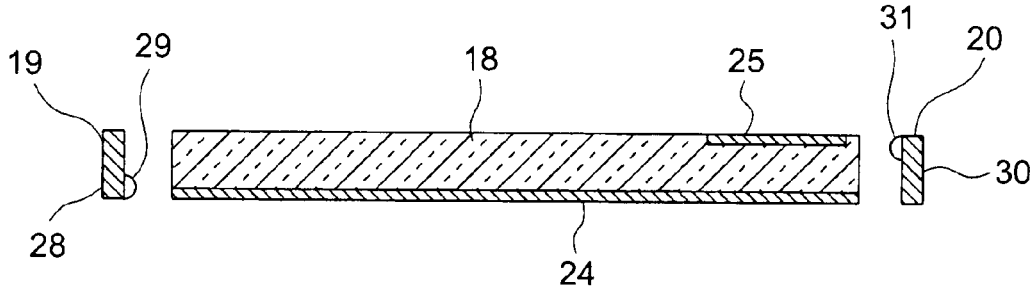
FIG. 8 is a partial cross section of the illuminating portion from FIG. 5.

FIG. 8 is a partial cross section of the illuminating portion 14 from FIG. 5. The position of the first LEDs 29 in the thickness direction of the light-guiding plate 18 is similar to that of the main diffusing portion 24. The position of the second LEDs 31 in the thickness direction of the light-guiding plate 18 is similar to that of the mark diffusing portion 25. Specifically, the main diffusing portion 24 and the mark diffusing portion 25 are disposed at different positions in the thickness direction of the light-guiding plate 18, and the position of injection of light from the main light source portion 19 to the light-guiding plate 18 and the position of injection of light from the mark light source portion 20 to the light-guiding plate 18 are offset in the thickness direction of the light-guiding plate 18 so as to correspond thereto.

Next, operation will be explained. In a state in which the plunger 4 is in a restored position, as shown in FIG. 3, the lever links 11*a* and 11*b* are in a valley fold posture in which two end portions (abutted end portions) thereof are positioned slightly closer to a bottom surface of the base 1 than intermediate portions (outer end portions). At this point, the operating tongue portion 6*f* is separated from the operating lug 7 of the switch main body 3, and the switch main body 3 is in an OFF state.

When an operating force is applied by pressing the push-button 15 in, and the plunger 4 is moved toward the base 1, the two end portions of the lever links 11*a* and 11*b* are also displaced toward the base 1, and the lever links 11*a* and 11*b* are pivoted around the pivoting points p. Spacing between the intermediate portions of the lever links 11*a* and 11*b* is thereby widened, the helical extension springs 13*a* and 13*b* are pulled, and resistance to operation increases slightly therewith.

As the lever links 11*a* and 11*b* are pivoted further, and the intermediate portions of the lever links 11*a* and 11*b* are moved closer to the bottom surface of the base 1 than the pivoting points p, the intermediate portions of the lever links 11*a* and 11*b* are pulled together by the restoring force of the helical extension springs 13*a* and 13*b*. The lever links 11*a* and 11*b* are thereby deformed to a peak fold posture instantaneously. At this point, resistance to the pressing operation is reduced instantaneously due to a snap action in which the direction of force is reversed, and a clicking sensation is thereby applied to the finger of the user.

The operating segment 6 is also displaced in a similar direction by the lever linking mechanism 5 performing the snap action and the helical extension springs 13*a* and 13*b* being moved toward the bottom surface of the base 1, and the operating lug 7 is depressed by the operating tongue portion 6*f*, setting the switch main body 3 to an ON state.

When the pressing operation on the push-button 15 is subsequently released, the operating segment 6 is moved away from the bottom surface of the base 1 by the restoring force of the operating lug 7, and the lever linking mechanism 5 is restored to the original valley fold posture by a reverse snap action. The plunger 4 is also restored to its original position therewith, and the switch main body 3 is set to an OFF state.

Here, when the switch main body 3 is set to the ON state, the main light source portion 19 is switched on, and light is injected into the light-guiding plate 18 from the main light source portion 19. The light that is injected into the light-guiding plate 18 from the main light source portion 19 is scattered by the main diffusing portion 24. The entire push-button 15 and display sheet 16 are illuminated thereby, indicating that destination floor registration has been executed. When the elevator car subsequently arrives at the destination floor, the main light source portion 19 is switched off.

The mark light source portion 20, on the other hand, is constantly switched on regardless of the switching on and off of the main light source portion 19. The light that is injected into the light-guiding plate 18 from the mark light source portion 20 is scattered by the mark diffusing portion 25. The mark 17 is constantly illuminated thereby, irrespective of the operational state of the switch main body 3.

In a push-button switch of this kind, reductions in thickness are enabled while ensuring a clicking sensation, and uniform illumination of the entire control surface can also be achieved.

Because the mark 17 is disposed on the push-button 15, and the mark diffusing portion 25 is also disposed on a portion of the light-guiding plate 18 that faces the mark 17, and light is injected into the light-guiding plate 18 from the mark light source portion 20 so as to be directed toward the mark diffusing portion 25, visibility of the mark 17 is improved, and functions can thereby be determined promptly by weak-sighted users, enabling operability to be improved.

Because the main diffusing portion 24 and the mark diffusing portion 25 are disposed at different positions in the thickness direction of the light-guiding plate 18, interference between light from the main light source portion 19 and light from the mark light source portion 20 can be easily avoided, enabling illumination that uses the main diffusing portion 24 and illumination that uses the mark diffusing portion 25 to be each controlled independently.

In addition, because the main light source portion 19 and the mark light source portion 20 are disposed so as to face each other on side surfaces of the light-guiding plate 18 that face each other, reductions in thickness of the illuminating portion 14 can be achieved.

Furthermore, because the LEDs 29 and 31 are used in the main light source portion 19 and the mark light source portion 20, reductions in size, power saving, and extension of service life can be achieved.

Because the mark diffusing portion 25 has a similar shape to the horizontal shape of the mark 17, and is disposed so as to overlap with the mark 17 when viewed from the front, the shape of the mark 17 can be shown more distinctly, enabling visibility to be improved further.

Embodiment 2

Figure 9:
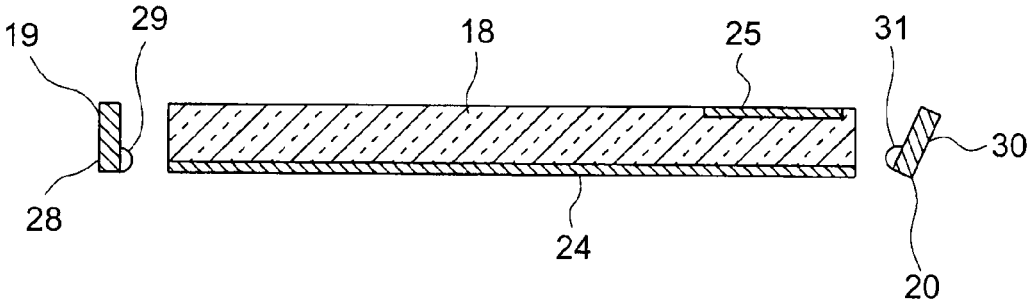
FIG. 9 is a partial cross section of a push-button switch according to Embodiment 2 of the present invention.

Next, FIG. 9 is a partial cross section of a push-button switch according to Embodiment 2 of the present invention. In this example, a mark light source portion 20 is disposed so as to be inclined relative to a light-guiding plate 18. Light from the mark light source portion 20 is thereby emitted so as to be inclined relative to a mark diffusing portion 25.

First LEDs 29 and second LEDs 31 are disposed at approximately identical positions in a thickness direction of the light-guiding plate 18. Specifically, in Embodiment 1, interference between light from the first and second LEDs 29 and 31 is avoided by offsetting the positions of the first and second LEDs 29 and 31 in the thickness direction of the light-guiding plate 18, but in Embodiment 2, optical interference is avoided by changing an angle of incidence of the light from the mark light source portion 20 into the light-guiding plate 18. The rest of the configuration is similar to that of Embodiment 1.

In a push-button switch of this kind, the mark light source portion 20 can be prevented from projecting beyond the front surface side of the light-guiding plate 18, further enabling overall reductions in thickness.

Embodiment 3

Figure 10:
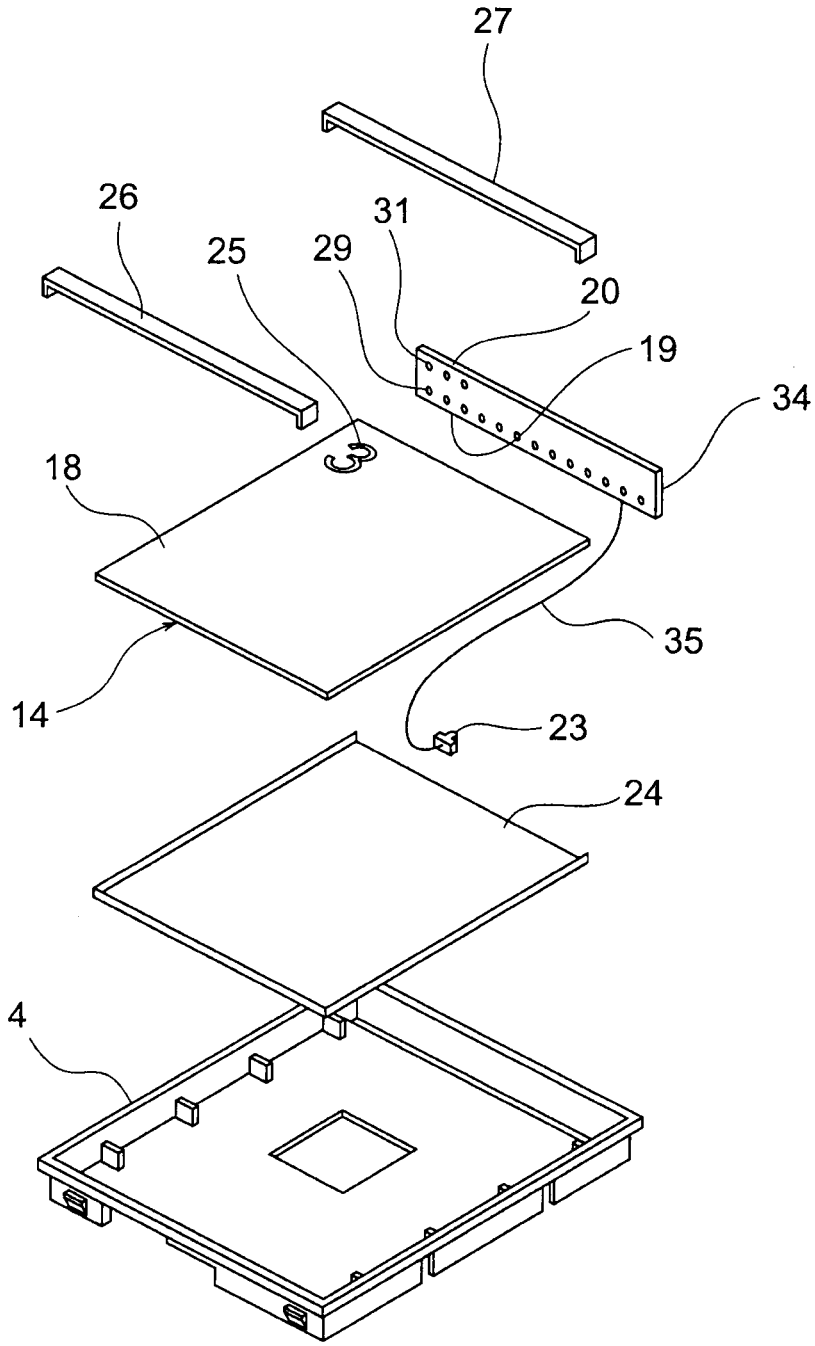
FIG. 10 is an exploded perspective that shows an illuminating portion of a push-button switch according to Embodiment 3 of the present invention.

Next, FIG. 10 is an exploded perspective that shows an illuminating portion of a push-button switch according to Embodiment 3 of the present invention. First and second LEDs 29 and 31 are disposed on a common light source circuit board 34 such that positions in a thickness direction of the light-guiding plate 18 are offset. In other words, the main light source portion 19 and the mark light source portion 20 are integrated. A light source connector 23 is connected to the light source circuit board 34 by means of wiring 35. The rest of the configuration is similar to that of Embodiment 1.

In a push-button switch of this kind, because the main light source portion 19 and the mark light source portion 20 are integrated, the number of parts can be reduced.

Embodiment 4

Figure 11:
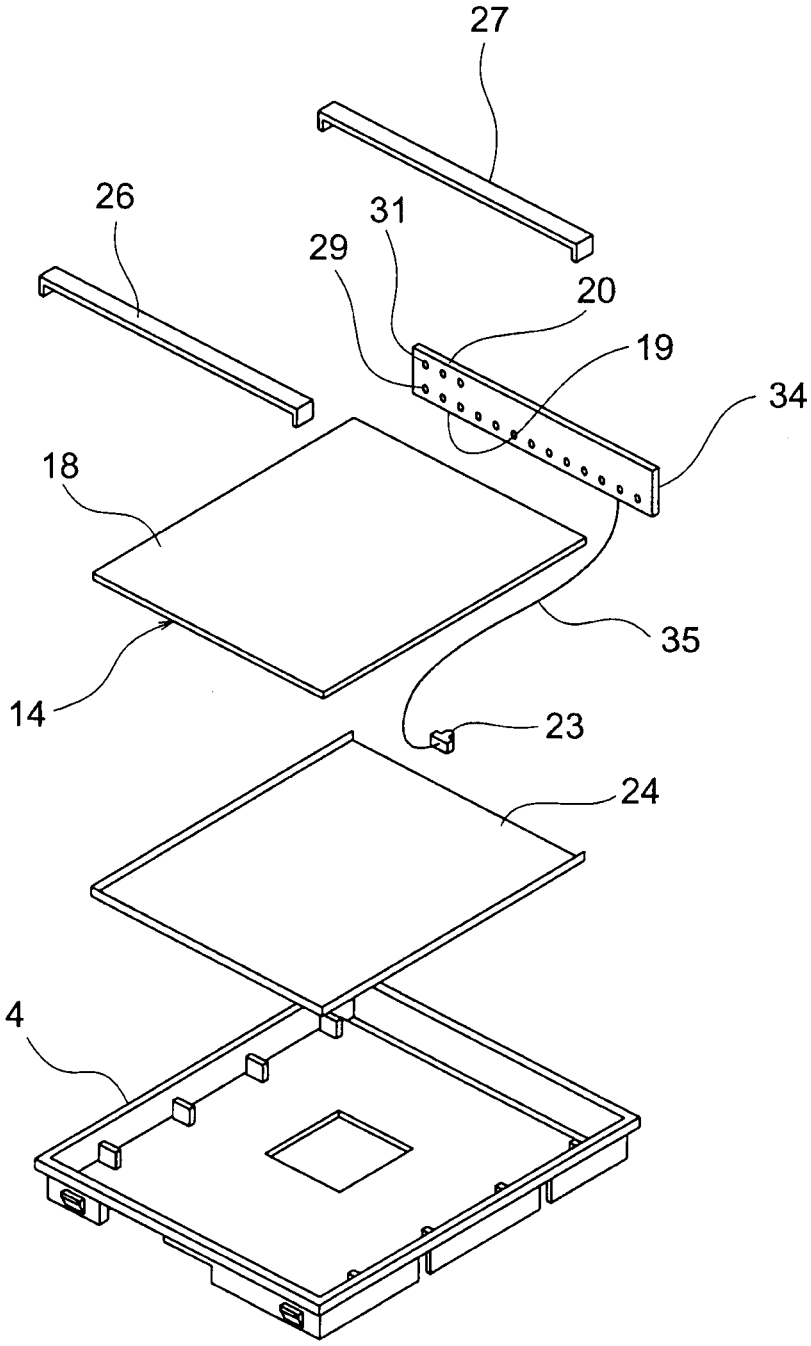
FIG. 11 is an exploded perspective that shows an illuminating portion of a push-button switch according to Embodiment 4 of the present invention.

Next, FIG. 11 is an exploded perspective that shows an illuminating portion of a push-button switch according to Embodiment 4 of the present invention. In Embodiment 3, the first and second LEDs 29 and 31 are disposed in identical positions in the width direction of the light-guiding plate 18, but in Embodiment 4, positions of first and second LEDs 29 and 31 are offset from each other in a width direction of the light-guiding plate 18. In other words, the first and second LEDs 29 and 31 are disposed so as to line up in the thickness direction of the light-guiding plate 18 in Embodiment 3, but do not line up in Embodiment 4. The rest of the configuration is similar to that of Embodiment 3.

In a push-button switch of this kind, distances between the first and second LEDs 29 and 31 in the thickness direction of the light-guiding plate 18 can be shortened, further enabling overall reductions in thickness.

Moreover, in the above examples, diffusing sheets that are separate from the light-guiding plate 18 are used as the main diffusing portion 24 and the mark diffusing portion 25, but the main diffusing portion 24 and the mark diffusing portion 25 may also be formed on the light-guiding plate 18 itself. Specifically, the main diffusing portion 24 and the mark diffusing portion 25 may also be minute indentations and protrusions that are formed on the light-guiding plate 18 by laser machining (laser marking), for example. The diffusing portions may also be formed by applying paint that diffuses light.

In the above examples, the mark 17 is disposed only at a single position on the front surface of the push-button 15, but may be disposed at a plurality of positions. In that case, it is preferable also to dispose the mark diffusing portion 25 at a plurality of positions.

In addition, in the above examples, the shape of the mark diffusing portion 25 is made similar to the mark 17, but may be another shape if the visibility of the mark 17 can be improved, and may also be a simple rectangular shape or circular shape, for example.

In the above examples, the mark light source portion 20 is constantly switched on, but may also be set so as to be switched on only when necessary.

It is preferable to use a leaf switch that can easily be reduced in thickness as the switch main body 3, but the switch main body 3 is not limited to this, and other types of switch that do not have a clicking action function may also be used.

In addition, in the above examples, LEDs 29 and 31 (point light sources) are used as light sources, but the light sources are not limited to this, and small-diameter tubular lamps (linear light sources) may also be used, for example.

In the above examples, the light source circuit boards 28 and 30, or 34 and the circuit board 2 are connected using wiring 21 and 22, or 35 and a connector 23 or 32, but conducting contacting segments that can be elastically deformed may also be projected toward the circuit board 2 from the light source circuit boards 28 and 30, or 34, and electrodes that these conducting contacting segments contact may be disposed on the circuit board 2.

In the above examples, two helical extension springs 13*a* and 13*b* are used, but the number of springs is not limited to this, and a single helical spring may also be disposed between the engaging portion 6*a* and 6*b*, for example.

In addition, in the above examples, the main diffusing portion 24 is disposed on a rear surface of the light-guiding plate 18, and the mark diffusing portion 25 is disposed on the front surface of the light-guiding plate 18, but these may also be disposed inside the light-guiding plate 18.

Furthermore, the main diffusing portion 24 may also be disposed on a front surface side of the light-guiding plate 18, and the mark diffusing portion 25 disposed on a rear surface side of the light-guiding plate 18.

In the above examples, the mark 17 is made to stand out from the front surface of the push-button 15, but may also be hollowed out as a recess portion, or may also be flat.

In addition, the push-button switch according to the present invention can also be applied to elevator landing button apparatuses.

Furthermore, the push-button switch according to the present invention can also be applied to uses other than elevators.

The invention claimed is:

1. A push-button switch comprising:

a plunger that includes a push-button that is made of a light-transmitting material;

a lever linking mechanism that translates the plunger; and a switch main body that is operated together with a pressing action of the plunger, the plunger, the lever linking mechanism, and the switch main body being mounted to a base, the lever linking mechanism comprising:

a pair of lever links that are disposed on the base so as to be abutted so as to be pivotable around an intermediate pivoting point; and joint members that link abutted end portions of the lever links to each other, the lever links being operable by the plunger, an operating segment that faces the switch main body being disposed so as to span the lever links, and the lever links being forced by springs that are engaged in outer end portions of the lever links so as to be pulled toward each other to enable the lever linking mechanism to perform a snap action in a direction of movement of the plunger together with a pivoting operation of the lever links that accompanies displacement of the plunger, the switch main body being configured so as to be pressed and operated by the operating segment that moves in the direction of movement of the plunger together with the action of the lever linking mechanism, and a flat illuminating portion that illuminates the push-button from behind being mounted so as to be able to move integrally with the plunger, wherein:

a mark for conveying information to a user is disposed on a portion of the push-button;

the illuminating portion comprises:

a light-guiding plate that is disposed between the switch main body and the push-button; and a mark light source portion;

a mark diffusing portion that diffuses injected light is disposed on a portion of the light-guiding plate that faces the mark;

light is injected into the light-guiding plate from the mark light source portion so as to be directed toward the mark diffusing portion;

the illuminating portion further comprises a main light source portion that injects light into the light-guiding plate;

a main diffusing portion that diffuses the light that is injected by the main light source portion is disposed on the light-guiding plate.

2. The push-button switch according to claim 1, wherein:

the mark diffusing portion and the main diffusing portion are disposed at different positions in a thickness direction of the light-guiding plate.

3. The push-button switch according to claim 2, wherein the mark light source portion and the main light source portion are disposed on mutually facing side surfaces of the light-guiding plate so as to face each other.

4. The push-button switch according to claim 2, wherein:

the main light source portion includes a plurality of first LEDs; and the mark light source portion includes a plurality of second LEDs that are fewer in number than the first LEDs.

5. The push-button switch according to claim 1, wherein the mark diffusing portion has a similar shape to a horizontal shape of the mark, and is disposed so as to overlap with the mark when viewed from a front surface.

* * * * *